United States Patent [19]

Hagerty

[11] 4,252,509

[45] Feb. 24, 1981

[54] FLUID HANDLING APPARATUS

[75] Inventor: John P. Hagerty, Prescott, Ariz.

[73] Assignee: Hagerty Research & Development Co., Inc., Prescott, Ariz.

[21] Appl. No.: 961,397

[22] Filed: Nov. 16, 1978

[51] Int. Cl.[3] ..... F01C 9/00; F04C 21/00

[52] U.S. Cl. ..... 417/482; 92/122

[58] Field of Search ..... 417/481, 482, 483, 484; 123/18 R; 92/121, 122, 123, 124, 125

[56] References Cited

U.S. PATENT DOCUMENTS

| | | | |
|---|---|---|---|
| 638,570 | 12/1899 | Forsyth | 123/18 R |
| 907,859 | 12/1908 | Neumann | 417/484 |
| 1,232,850 | 7/1917 | Saunders | 123/18 R X |
| 1,467,619 | 9/1923 | Hull | 417/481 |
| 1,516,584 | 11/1924 | Wilson | 417/482 |
| 2,359,819 | 10/1944 | Bachrach | 417/481 |

FOREIGN PATENT DOCUMENTS

| | | | |
|---|---|---|---|
| 114904 | 4/1918 | United Kingdom | 123/18 R |
| 252997 | 6/1926 | United Kingdom | 417/481 |

*Primary Examiner*—Leonard E. Smith
*Attorney, Agent, or Firm*—Allen D. Gutchess, Jr.

[57] ABSTRACT

Apparatus for handling fluid is provided. The apparatus can serve to pump fluid and increase its pressure when power is applied to a shaft, or the apparatus can drive the shaft when fluid under pressure is supplied. The apparatus includes a housing having a plurality of chambers formed therein in a circular pattern. Each of the chambers includes two generally triangularly-shaped cavities communicating at apexes and positioned symmetrically with respect to a center line extending through the apexes. The chamber also is of a generally bow-tie shaped configuration. Each of the chambers has a piston therein which is oscillated about an axis at the center line of the chambers. The piston is generally of the same shape as the chamber but narrower. Each cavity has intake lines and outlet lines through which fluid flows as the piston oscillates therein. The pistons have arms extending outside the chambers and driven to oscillate the pistons. In a preferred form, the arms are engagable by a rotary cam which causes the arms to oscillate and, therefore, the pistons to do the same.

10 Claims, 12 Drawing Figures

FLUID HANDLING APPARATUS

This invention relates to apparatus for handling fluids. And more particularly to rotary apparatus of the positive displacement type.

This invention is disclosed in Disclosure Documents 71,353 and 72,550.

The apparatus according to the invention has a shaft which can serve as an input shaft to pump fluid when the power is applied thereto. If fluid is supplied to the apparatus under higher pressure, then the shaft can be driven with the fluid serving as a working medium.

The apparatus includes a housing in which are a plurality of chambers positioned in a circular pattern. Each of the chambers comprises two generally triangularly-shaped cavities which communicate with one another at their apexes and are symmetrically positioned with respect to a center line extending through the apexes thereof. The chamber also can be said to be of a generally bow-tie configuration. Each chamber has a piston therein positioned to oscillate about an axis at the center line. The pistons are generally similar in shape to the chambers but of narrower configuration to enable oscillation therein. In a preferred form, each of the cavities has an inlet line and an outlet line located on each side of the piston so that as the piston moves in one direction, fluid enters the cavity on one side and leaves on the opposite side and vice versa, with the other cavity of the chamber operating in the same manner to provide high throughput for minimum piston movement and compactness. The pistons are affixed to arms extending outside the chambers and are oscillated through a rotary cam rotating within the housing. The circular arrangement of the chambers and pistons also provides a compact, efficient design.

It is, therefore, a principal object of the invention to provide improved fluid handling apparatus having the features and advantages discussed above.

Many other objects and advantages of the invention will be apparent from the following detailed description of preferred embodiments thereof, reference being made to the accompanying drawings in which.

Figure 1:
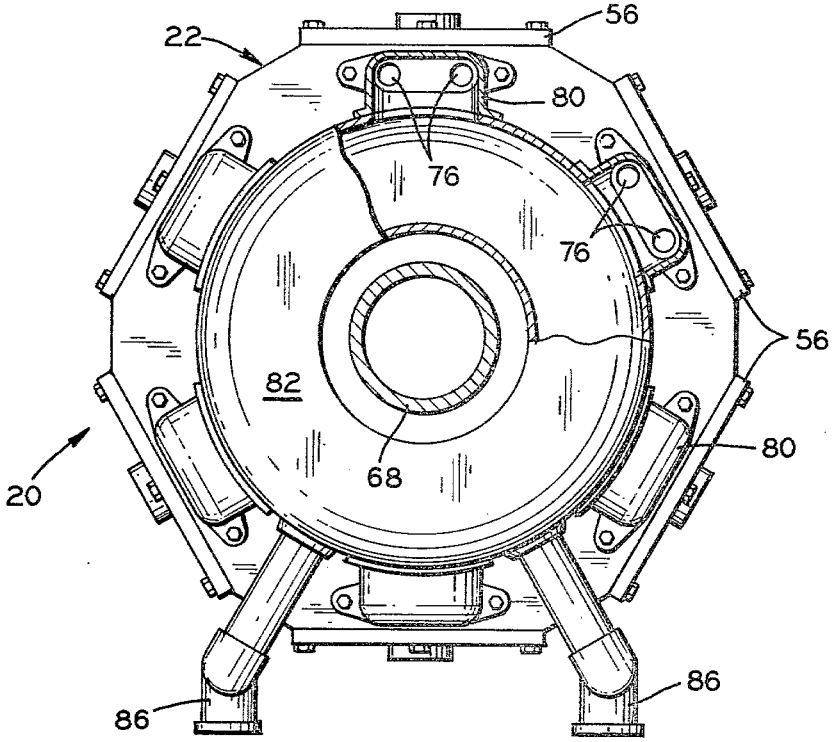
FIG. 1 is a front view in elevation, with parts broken away and with parts in section, of apparatus embodying the invention.
Figure 2:
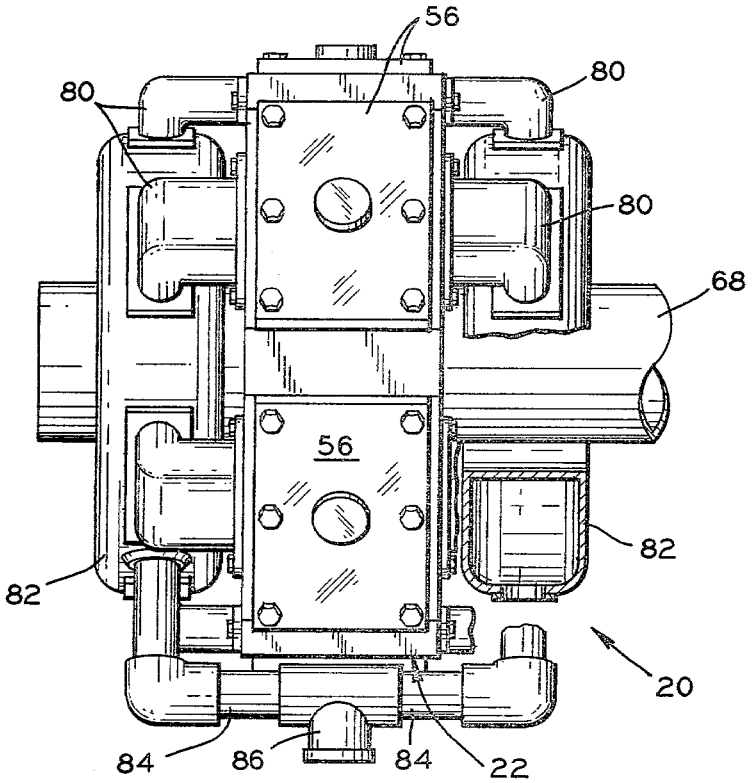
FIG. 2 is a side view in elevation, with parts broken away and with parts in section, of the apparatus of FIG. 1.
Figure 3:
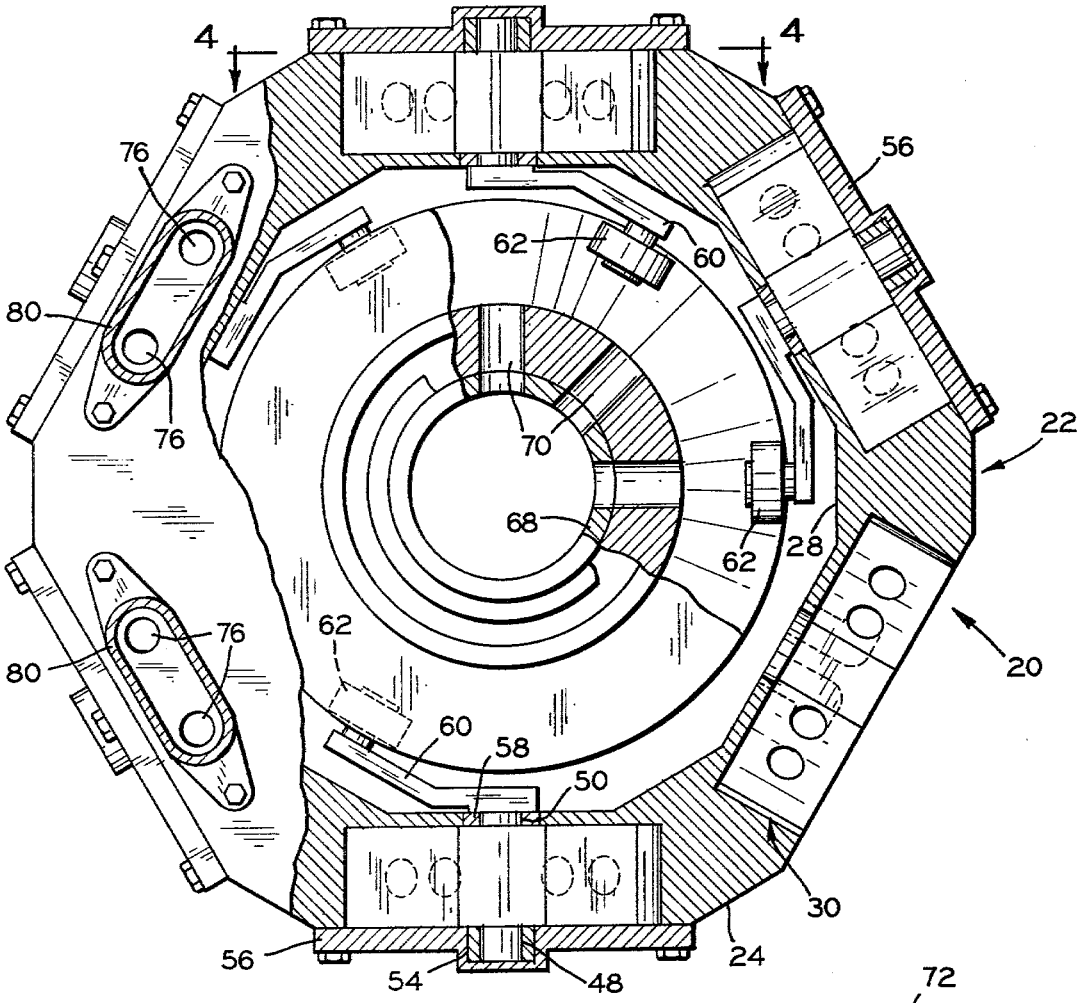
FIG. 3 is an enlarged view in elevation, with further parts broken away and with parts in cross-section, of the apparatus of FIGS. 1 and 2.
Figure 4:
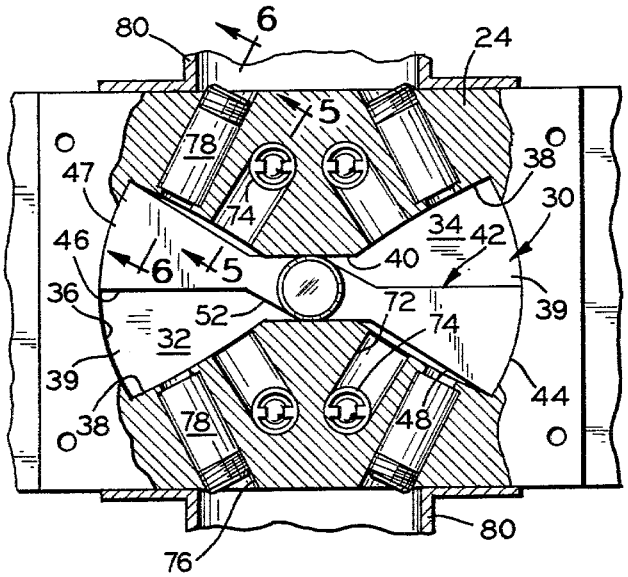
FIG. 4 is a view in cross-section, taken generally along the line 4—4 of FIG. 3.
Figure 5:
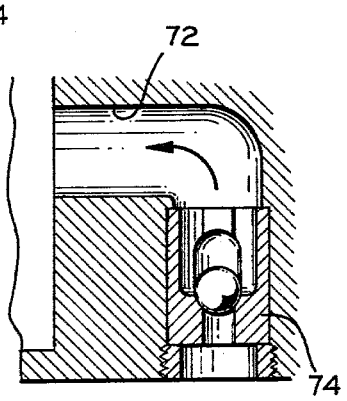
Figure 6:
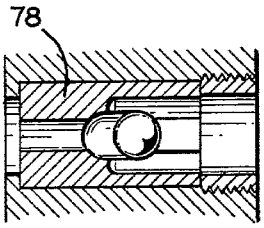
Figure 7:
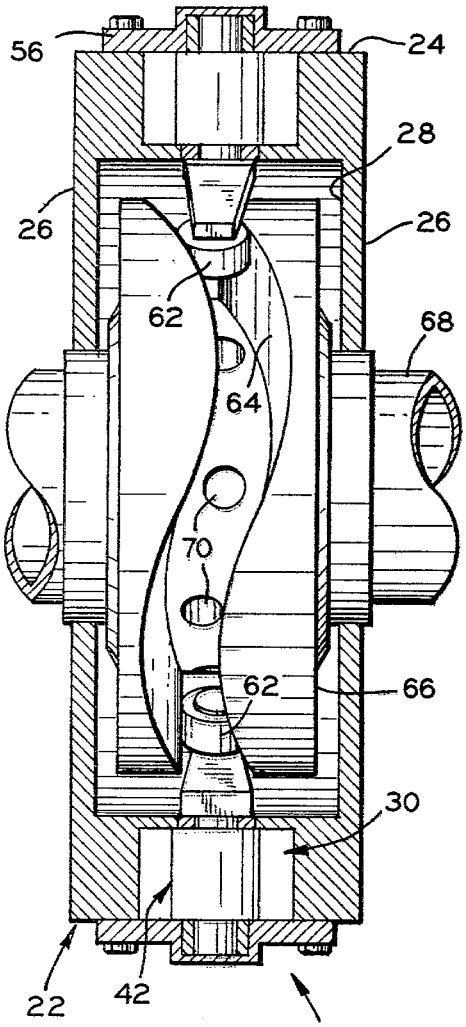
Figure 8:
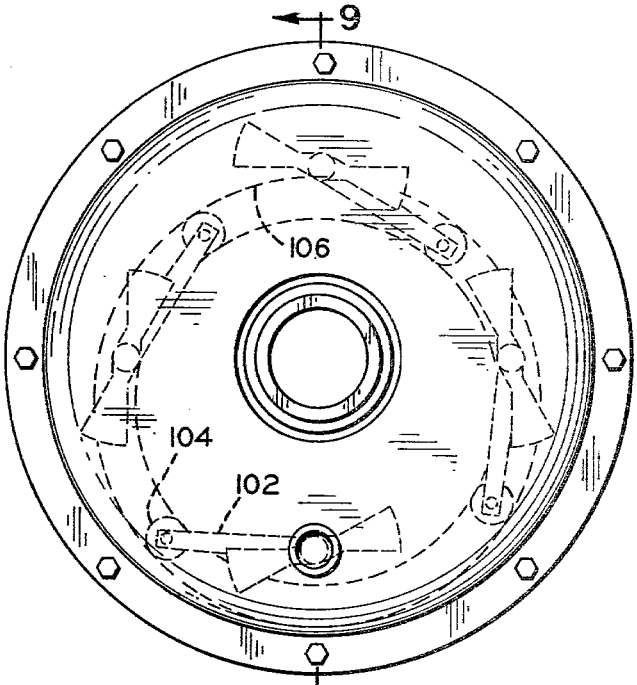
Figure 9:
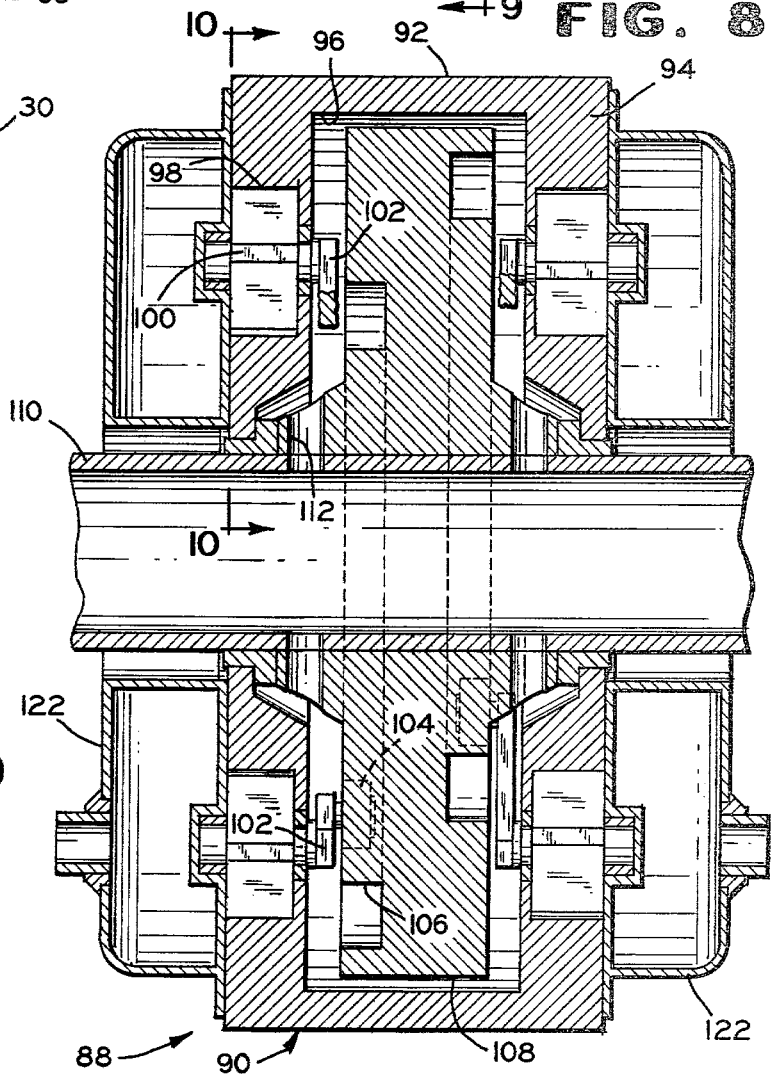
Figure 10:
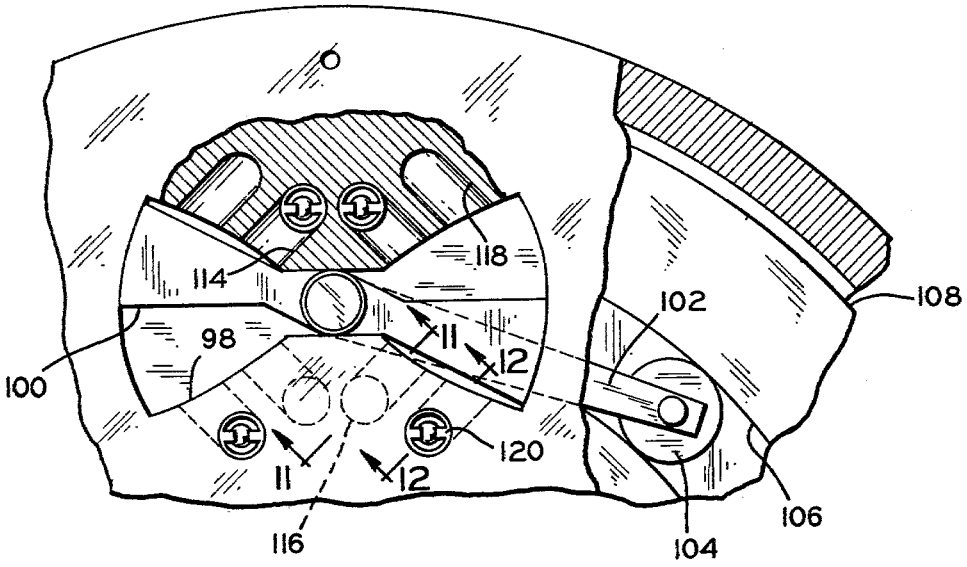
Figure 11:
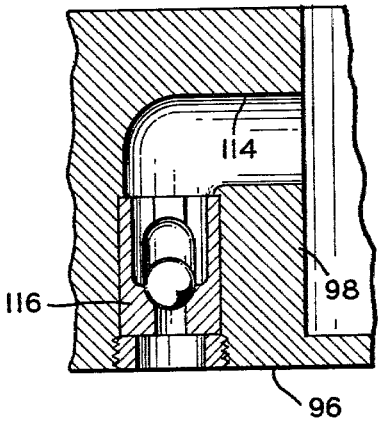
Figure 12:
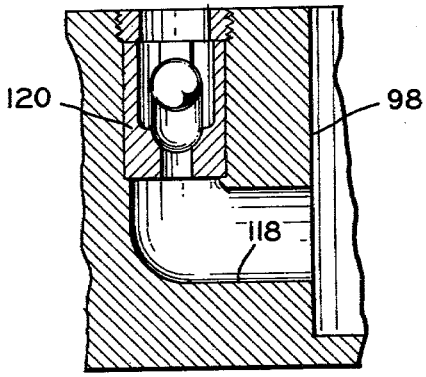

FIGS. 5 and 6 are views in section taken along the lines 5—5 and 6—6, repsectively of FIG. 4;

FIG. 7 is a view in generally vertical cross-section, with parts shown in elevation, of the apparatus of FIGS. 1–3;

FIG. 8 is a somewhat schematic view in elevation, with parts shown in dotted lines, of modified apparatus embodying the invention;

FIG. 9 is an enlarged view in vertical cross-section taken along the line 9—9 of FIG. 8;

FIG. 10 is a fragmentary view taken generally along the line 10—10 of FIG. 9; and FIGS. 11 and 12 are views in section taken along the lines of 11—11 and 12—12, respectively, of FIG. 10.

Referring to FIGS. 1–7, apparatus for handling fluid in accordance with the invention is indicated at 20 and includes a housing 22 having a thick outer wall 24 and end walls 26 forming an intake chamber or space 28. A plurality, in this instance six, chambers 30 (see particularly FIGS. 3 and 4) are formed in the housing outer wall 24. Each of the chambers 30 has two generally triangular cavities 32 and 34, each with an arcuate base wall 36, straight side walls 38, and planar, parallel end walls 39. The cavities are symmetrical about a center line extending transversely to the cavities and through the point where the side walls would otherwise meet, if extended. The cavities 32 and 34 themselves do not meet at that point but terminate in a short, straight passage 40. Stated another way, each of the chambers 30 is of a bow-tie shaped configuration .

An oscillatable piston 42 is located in each of the chambers 30 and is of generally similar, but narrower, shape. The piston includes arcuate base walls 44 and straight side walls 46 and planar, parallel end walls 47. The piston oscillates about an outer axle 48 and a short shaft 50 which extends out of the chamber 30. The straight side walls do not continue to the shaft and axle but diverge at shorter walls 52 (FIG. 4). The axle 48 is rotatably held in a suitable bearing 54 in an outer cover plate 56 while the shaft 50 extends through a bearing sleeve 58 and is connected to an arm 60 within the space 28 formed by the housing.

To oscillate the piston 42, the arm 60 has an inwardly-extending roller 62 projecting into a groove 64 (FIGS. 3 and 7) formed in a circular cam 66. The cam 66 rotates with a shaft 68 extending outwardly beyond both end walls 26 of the housing 22. The cam 66 either is driven by the shaft 68 or drives it, depending upon the manner in which the apparatus 20 is operated. As shown, the groove 64 in the cam 66 has three lobes about its periphery to cause each of the pistons to oscillate three times during one rotation of the cam. Even with one lobe and one oscillation of each of the pistons 42, there will be twelve compression strokes during one revolution of the cam and the shaft 68 when the apparatus is driven as a pump or compressor. Similarly there will be twelve power strokes when the apparatus is operated as a motor.

Fluid to be supplied to the chambers 30 can be supplied through the shaft 68 from one end, the shaft being hollow. The fluid then is supplied through inlet ports 70 in the cam 66 and into the housing space or chamber 28. Inlet passages 72 (FIG. 5) are located in the outer thick wall 24 and communicate at lower ends with the housing space 28. Check valves 74 are located in the inlet passages 72 to enable fluid to pass only from the space 28 to the chambers 30. There is one of the inlet passages 72 and one of the check valves 74 for each side of each of the cavities 32 and 34 of the chamber 30. Similarly, there is an outlet passage 76 on each side of each of the cavities 32 and 34 of the chambers 30. These outlet passages have check valves 78 which enable flow of fluid only from the cavities outwardly.

The outlet passage 76 on each side of each of the chambers 30 communicates with an outlet manifold 80 (FIGS. 1, 2, and 4). These six manifolds on each side of the housing 22, in turn, communicate with a receiver tank 82. Cross-over manifolds 84 communicate with both receiver tanks and equalize pressure with these connecting with two delivery outlets 86.

When the apparatus 20 is used as a compressor, air can be drawn into the housing from the end of the shaft 68 which is not driven . If outside air is used, the shaft at that end can be provided with a suitable filter.

If desired, as disclosed in the aforesaid Disclosure Document 71,353, the cam 66 can be located around the chambers 30 with the piston arms extending outwardly from the chambers rather than inwardly.

Slightly modified apparatus embodying the invention is shown in FIGS. 8–12. In this instance, apparatus 88 includes a housing 90 having a thin outer wall 92 and thick end walls 94 forming an intake chamber or space 96. In this instance, chambers 98 are formed in the end walls 94, four being shown, for a total of eight. Pistons 100 are located in the chambers 98, the chambers and pistons being basically the same as those of the first embodiment and will not be discussed in detail. The pistons have side arms 102 with rollers 104 received in grooves 106 of a circular cam member 108. The grooves, as shown, have one lobe so that each of the pistons makes one complete oscillation for each revolution of the cam 108.

Fluid can be supplied to the chambers through a hollow shaft 110 and through outer inlet ports 112 to the space 96. As shown in FIG. 11. inlet passages 114 with check valves 116 communicate with the spaces 96 and with the chambers.

On the outlet side, the chambers have outlet passages 118 with check valves 120. The passages 118 communicate with two receiver tanks 122 at the sides of the housing 90. Fluid from the tanks 122 can flow through suitable ports and passages.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Apparatus for handling fluids comprising a housing having thick walls in which a plurality of chambers are formed, each of said chambers having a transverse cross-sectional shape generally in the form of a bow tie, with parallel, planar, end walls, a piston in each of said chambers having a transverse cross-sectional shape similar to that of the chamber, but narrower, said chambers and said pistons being symmetrically located in a generally circular pattern about a central axis, means for oscillating each of said pistons about a central axis with end portions of the piston extending into the end portions of the chamber and oscillatable therein, said oscillating means comprising an arm for each of said pistons extending through an end wall of each of said chambers and into the interior of said housing, a rotatable cam within said housing and having a groove receiving said arms, and a shaft for rotating said cam about an axis of rotation coextensive with said circular pattern axis, means communicating with the interior of said housing for supplying fluid thereto, each of said chambers having an inlet passage communicating with the interior of said housing, means forming a receiver tank outside said housing, outlet passage means communicating with each of said chambers, and means connecting said outlet passage means with said receiver tank.

2. Apparatus according to claim 1 characterized by each of said chambers having four of said inlet ports and four of said outlet passage means.

3. Apparatus according to claim 1 characterized by said chambers being positioned around the periphery of said rotatable cam with the central axes of the pistons being perpendicular to the axis of rotation of said cam.

4. Apparatus according to claim 1 characterized by said chambers being disposed in two generally circular patterns about a common central axis with said rotatable cam positioned between the two circular patterns of chambers with the axis of rotation of said cam being parallel to the central axes of said pistons.

5. Apparatus according to claim 4 characterized by said cam having two faces parallel to one another and perpendicular to the axis of rotation with a groove being located in each of said faces.

6. Apparatus for handling fluid comprising a housing having thick walls in which a plurality of chambers are formed, each of said chambers having two generally triangularly shaped cavities, each with an arcuate base wall, generally straight side walls, and parallel, planar end walls, the cavities of each of said chambers being symmetrical about a center line extending transversely to the cavities, and the cavities of each of said chambers communicating with one another by a short passage extending therebetween, an oscillatable piston located in each of said chambers and being of generally similar, but narrower shape, each of said pistons also including arcuate base walls, generally straight side walls, and parallel, planar end walls, said chambers and said pistons being located symmetrically in a generally circular pattern about a central axis, each of said pistons being oscillatable about a central axis with end portions of each of said pistons extending into the corresponding cavities, an arm for each of said pistons extending through an end wall of each of said chambers and into the interior of said housing, a rotatable cam in the interior of said housing, said cam having a portion receiving portions of said arms whereby said arms oscillate when said cam rotates, a shaft for rotating said cam about an axis of rotation coextensive with the central axis of the circular pattern, said shaft being hollow and having openings communicating with the interior of said housing for supplying fluid thereto, each of said chambers having inlet passage means communicating with the interior of said housing for supplying fluid therefrom to said chamber, at least one receiver tank, and outlet passage means communicating with each of said chambers and said receiver tank.

7. Apparatus according to claim 6 characterized by said receiver tank being located adjacent one side of said housing, a second receiver tank located on the opposite side of said housing, said chambers being located in side walls of said housing with the chambers in each side wall being in a circular pattern, said outlet passage means of the chambers of one of said circular patterns communicating with said receiver tank and the outlet passage means of the chambers of the other of said circular pattern communicating with said second receiver tank.

8. Apparatus according to claim 6 characterized by said chambers being positioned around the periphery of said rotatable cam with the central axes of the pistons being perpendicular to the axis of rotation of said cam.

9. Apparatus according to claim 6 characterized by said chambers being disposed in two generally circular patterns about a common central axis with said rotatable cam positioned between the two circular patterns of chambers with the axis of rotation of said cam being parallel to the central axes of said pistons.

10. Apparatus according to claim 9 characterized by said cam having two faces parallel to one another and perpendicular to the axis of rotation, with a groove located in each of said faces and receiving portions of said arms.

* * * * *